US011992065B2

(12) United States Patent
Wang et al.

(10) Patent No.: US 11,992,065 B2
(45) Date of Patent: May 28, 2024

(54) ELECTRONIC VAPORIZING-DEVICE AND REMINDING METHOD IN ELECTRONIC VAPORIZING-DEVICE

(71) Applicant: Shenzhen Smoore Technology Limited, Shenzhen (CN)

(72) Inventors: Shengli Wang, Shenzhen (CN); Qingshan Cheng, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 450 days.

(21) Appl. No.: 17/117,914

(22) Filed: Dec. 10, 2020

(65) Prior Publication Data

US 2021/0186115 A1 Jun. 24, 2021

(30) Foreign Application Priority Data

Dec. 20, 2019 (CN) ..... 201911326017.5

(51) Int. Cl.
*A24F 40/60* (2020.01)
*A24F 40/53* (2020.01)

(52) U.S. Cl.
CPC ..... *A24F 40/60* (2020.01); *A24F 40/53* (2020.01)

(58) Field of Classification Search
None
See application file for complete search history.

(56) References Cited

U.S. PATENT DOCUMENTS

| | | | |
|---|---|---|---|
| 2013/0340775 | A1 | 12/2013 | Juster et al. |
| 2015/0173124 | A1 | 6/2015 | Qiu |
| 2015/0230521 | A1 | 8/2015 | Talon |
| 2018/0020728 | A1 | 1/2018 | Alarcon et al. |

FOREIGN PATENT DOCUMENTS

| | | | | |
|---|---|---|---|---|
| CN | 203943074 | U | * | 11/2014 |
| CN | 203943074 | U | | 11/2014 |
| CN | 104886780 | A | * | 9/2015 |
| CN | 104886780 | A | | 9/2015 |
| CN | 109419042 | A | | 3/2019 |
| CN | 109875133 | A | | 6/2019 |
| EP | 2959787 | A1 | | 12/2015 |
| EP | 3357356 | A1 | | 8/2018 |
| JP | 3332658 | A2 | | 6/2018 |

OTHER PUBLICATIONS

Chinese Second Office Action, Chinese Application No. 201911326017.5, dated Mar. 8, 2022(15 pages).
European search report, European Application No. 20212318.8, dated May 17, 2021(7 pages).
Chinese Rejection Decision, Chinese Application No. 201911326017.5, dated Mar. 11, 2022(11 pages).
Chinese First Office Action, Chinese Application No. 201911326017.5, dated Mar. 3, 2022(16 pages).

* cited by examiner

*Primary Examiner* — Phu H Nguyen

(57) ABSTRACT

A reminding method in an electronic vaporizing-device and an electronic vaporizing-device are disclosed. The method includes detecting an electrical parameter of the vaporizer, determining whether the vaporizer is detached from the battery based on the electrical parameter of the vaporizer, and generating a reminder in response to the vaporizer being detached from the battery.

8 Claims, 4 Drawing Sheets

ELECTRONIC VAPORIZING-DEVICE AND REMINDING METHOD IN ELECTRONIC VAPORIZING-DEVICE

CROSS-REFERENCE TO RELATED APPLICATIONS

This application claims priority to Chinese Patent Application No. 201911326017.5, filed on Dec. 20, 2019, the content of which is herein incorporated by reference in its entirety.

TECHNICAL FIELD

The present disclosure relates to electronic vaporizing-devices and a reminding method in an electronic vaporizing-device.

BACKGROUND

Electronic vaporizing-devices in the current market are customer products developed for adults. An electronic vaporizing-device includes a battery and a vaporizer. Traditionally, no reminding function is provided when the vaporizer is detached from the battery while the electronic vaporizing-device is in operation, which may influence user experience of the electronic vaporizing-device.

SUMMARY

According to one aspect of the present disclosure, a reminding method in an electronic vaporizing-device is provided. The electronic vaporizing-device includes a battery and a vaporizer detachably connected to the battery, and the method includes detecting an electrical parameter of the vaporizer, determining whether the vaporizer is detached from the battery based on the electrical parameter of the vaporizer, and generating a reminder in response to the vaporizer being detached from the battery.

According to another aspect of the present disclosure, an electronic vaporizing-device is provided. The electronic vaporizing-device includes a battery, a vaporizer detachably connected to the battery, a memory storing program instructions, and a processor. The processor is configured to execute the program instructions to perform: detecting an electrical parameter of the vaporizer; determining whether the vaporizer is detached from the battery based on the electrical parameter of the vaporizer; and generating a reminder in response to the vaporizer being detached from the battery.

According to another aspect of the present disclosure, a non-transitory computer readable storage medium is provided. The non-transitory computer readable storage medium stores program instructions, when executed by a processor, causes the processor to perform: detecting an electrical parameter of the vaporizer; determining whether the vaporizer is detached from the battery based on the electrical parameter of the vaporizer; and generating a reminder in response to the vaporizer being detached from the battery.

BRIEF DESCRIPTION OF THE DRAWINGS

In order to clearly explain the technical solutions in the embodiments of the present disclosure, the drawings used in the description of the embodiments will be briefly described below. Obviously, the drawings in the following description are merely some embodiments of the present disclosure. For those of ordinary skill in the art, other drawings may also be obtained based on these drawings without any creative work.

DETAILED DESCRIPTION

The disclosure will now be described in detail with reference to the accompanying drawings and examples. Apparently, the described embodiments are only a part of the embodiments of the present disclosure, not all of the embodiments. All other embodiments obtained by a person of ordinary skill in the art based on the embodiments of the present invention without creative efforts shall fall within the protection scope of the present invention.

Figure 1:
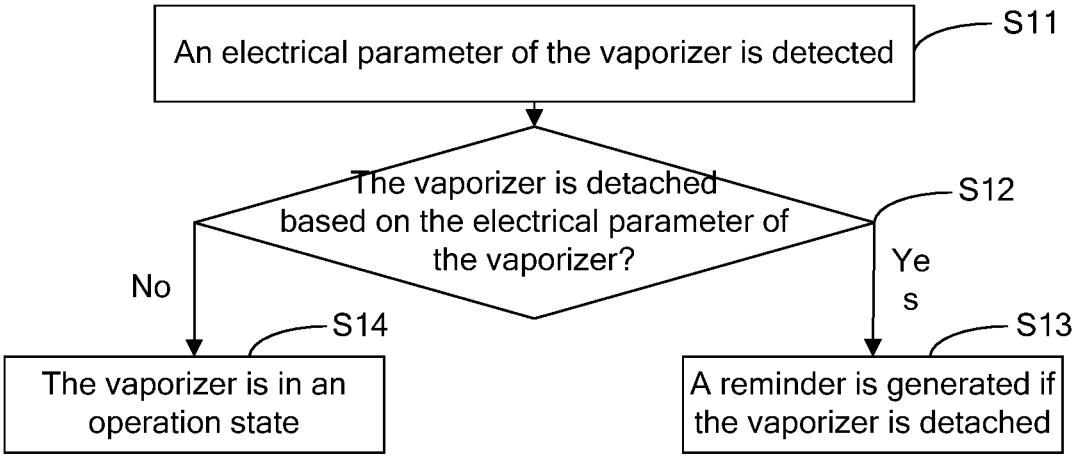
FIG. 1 is a flowchart of a reminding method in an electronic vaporizing-device according to some embodiments of the present disclosure.

FIG. 1 is a flowchart of a reminding method in an electronic vaporizing-device according to some embodiments of the present disclosure. In one embodiment, the electronic vaporizing-device includes a vaporizer and a battery detachably connected to the vaporizer. In this embodiment, the method may include the following operations.

S11: An electrical parameter of the vaporizer is detected.

The vaporizer may include one or more heating component such as a resistance wire. The heating components are powered by the battery and may generate heat so as to vaporize tobacco liquid (or other similar material) near the heating components to generate smoke for the user.

The electrical parameter is electrical data of the vaporizer in operation, which can be used to detect whether the device is in an abnormal state. For example, the electrical parameter may be the current in the vaporizer, the resistance of a resistance wire in the vaporizer, the voltage between two ends of the resistance wire in the vaporizer, etc. It should be noted that, an example of the resistance wire being used as a heating component is described in the present disclosure to describe the electrical parameters of the vaporizer, and it can be appreciated that it is not limited to the resistance wire herein.

For example, the voltage between two ends of the resistance wire in the vaporizer and the current passing through the vaporizer may be detected, and the resistance of the resistance wire can be acquired based on the equation $$R = \frac{U}{I}.$$

S12: It is determined whether the vaporizer is detached based on the electrical parameter of the vaporizer.

By detecting or calculating the electrical parameter of the vaporizer, it can be determined whether the vaporizer is detached. For example, when it is detected that the current passing through the heating components in the vaporizer is smaller than a preset current, it can be determined that the vaporizer is detached from the battery. That is, the vaporizer is in a power-off state when vaporizer is detached from the battery. Alternatively, when it is detected that the resistance of the resistance wire in the heating components of the vaporizer is greater than a value when the vaporizer is in an operation state, it can be determined that the vaporizer is not capable of generating smoke, because it is possible the vaporizer has detached from the battery.

If it is determined that the vaporizer is detached in S12, operations in block S13 may be performed. Otherwise, if it is determined that the vaporizer is not detached in S12, operations in block S14 may be performed.

S13: A reminder is generated if the vaporizer is detached.

In some embodiments, various kinds of light sources, e.g., LED light or breathing light, may be arranged on the electronic vaporizing-device. Specifically, the light sources may be arranged on an end of the vaporizer away from the battery. The LED light may be coupled to the battery and powered by the battery. When it is determined that the vaporizer is detached, the LED light may be utilized to remind the user.

In other embodiments, a sound display device may be arranged on the electronic vaporizing-device. The sound display device may be coupled to the battery and powered by the battery. When it is determined that the vaporizer is detached, the sound display device may be utilized to remind the user.

In other embodiments, a vibration device may be arranged on the electronic vaporizing-device. The vibration device may be coupled to the battery and powered by the battery. When it is determined that the vaporizer is detached, vibration may be generated to remind the user. It should be understood the above embodiments are merely for illustrative purpose, and the scope of the present disclosure is not limited therein.

S14: It is determined that the vaporizer is in an operation state.

When the vaporizer is in the operation state, the electronic vaporizing-device may not generate any reminder to the user or may set the LED light in a normally on condition to notify the user. The operation state indicates that the vaporizer is in a powered-on state.

Compared with prior art, the reminding method in an electronic vaporizing-device in this embodiment includes: detecting an electrical parameter of the vaporizer; determining whether the vaporizer is detached based on the electrical parameter of the vaporizer; and based on the determination that the vaporizer is detached, generating a reminder. In this implementation, a reminder may be sent to the user when the vaporizer is detached, which may improve user experience.

Figure 2:
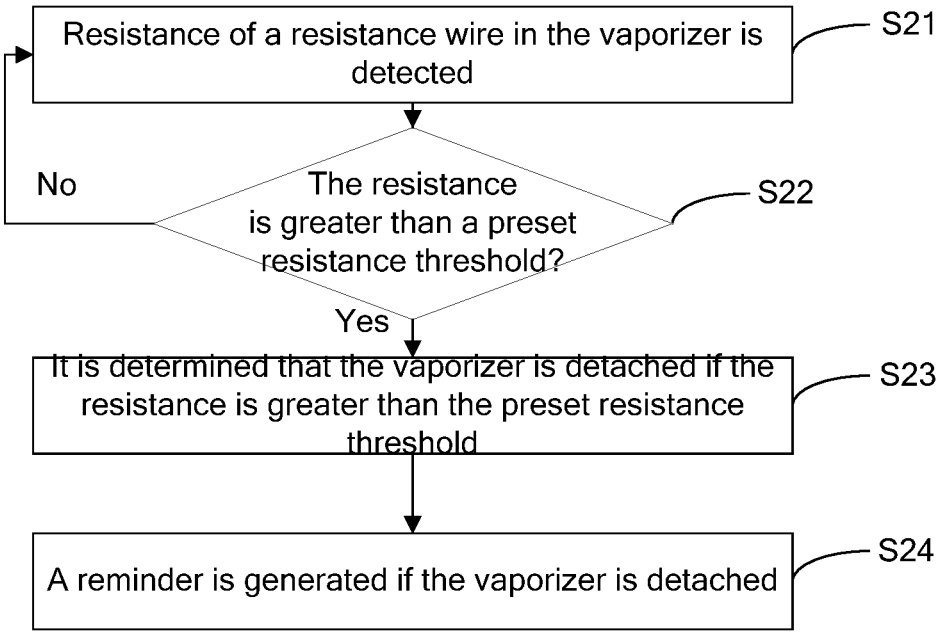
FIG. 2 is a flowchart of a reminding method in an electronic vaporizing-device according to other embodiments of the present disclosure.

FIG. 2 is a flowchart of a reminding method in an electronic vaporizing-device according to another some embodiments of the present disclosure. In this embodiment, the electronic vaporizing-device includes a vaporizer and a battery that are detachably connected. The method of the embodiment includes the following operations.

In this embodiment, the scheme where the resistance of a resistance wire in the vaporizer is detected is adopted in order to explain the method.

S21: A resistance of a resistance wire in the vaporizer is detected.

Similar to S11, the voltage between two ends of the resistance wire in the vaporizer and the current passing through the vaporizer may be detected, and the resistance of the resistance wire can be acquired based on the equation $$R = \frac{U}{I}.$$

In some embodiments, the resistance of the resistance wire in the vaporizer may be continuously detected at a preset frequency. For example, the resistance of the resistance wire in the vaporizer may be detected in every 200 ms.

S22: It is determined whether the acquired resistance is greater than a preset resistance threshold.

Corresponding to block S21, the determination of whether the resistance of the resistance wire in the vaporizer is greater than the preset resistance threshold may be performed at a preset frequency.

In some embodiment, the preset resistance threshold may be 0.6 to 1.5 Ohms, and can be determined based on user requirement. For example, if the user prefers a better smoke taste, the resistance of the resistance wire may be 1.2 Ohms and the preset resistance threshold may be 1.5 Ohms. If the user prefers a relatively large amount of smoke, the resistance of the resistance wire may be 0.5 Ohm and the preset resistance threshold may be 0.6 Ohm.

If it is determined that the acquired resistance is greater than the preset resistance threshold in block S22, operations in block S23 may be performed. Otherwise, detection of the resistance of the resistance wire in the vaporizer may be performed continuously.

S23: It is determined that the vaporizer is detached if the acquired resistance is greater than the preset resistance threshold.

When the acquired resistance of the resistance wire is greater than the preset resistance threshold of the resistance wire, it can be determined that the entire electronic vaporizing-device is in a no-load condition and the vaporizer is detached from the battery.

S24: A reminder is generated if the vaporizer is detached.

In this embodiment, if the resistance of the resistance wire in the vaporizer is greater than the preset resistance threshold, it is determined that the vaporizer is slowly detached, and a first way may be adopted to remind the user.

It should be clarified, the electronic vaporizing-device in use may collide with other objects or may fall. In this situation, the vaporizer and the battery in the device may be detached from each other. Alternatively, as time passes the connected between the vaporizer and the battery may loose. These are two exemplary scenarios where the vaporizer is slowly detached.

The first way may include setting the LED light to flash. Specifically, visible light, e.g., white light, may be used to flash at a preset frequency (e.g., every 500 ms). In some embodiments, the light may be kept flashing at a same frequency while the intensity may be raised from low to high to remind the user that the vaporizer is detached slowly.

In some embodiments, the first way may include utilizing a sound display device to remind the user. Specifically, the sound display device may be controlled to generate sound to surroundings at a constant frequency. For example, it can generate a beep sound. In some embodiments, the frequency of the sound may be kept constant while the intensity may be slowly raised from low to high to remind the user that the vaporizer is detached.

In some embodiments, the first way may include using a vibration device to remind the user. Specifically, the vibration device may cause the entire electronic vaporizing-device to vibrate at a constant frequency. In some embodiments, the intensity of the vibration may be controlled to slowly rise from low to high to remind the user that the vaporizer is detached.

Compared with prior art, the reminding method in an electronic vaporizing-device in this embodiment may determine whether the vaporizer is detached by detecting the resistance of the resistance wire in the vaporizer, and then remind the user accordingly. Thus, the user experience may be improved.

Figure 3:
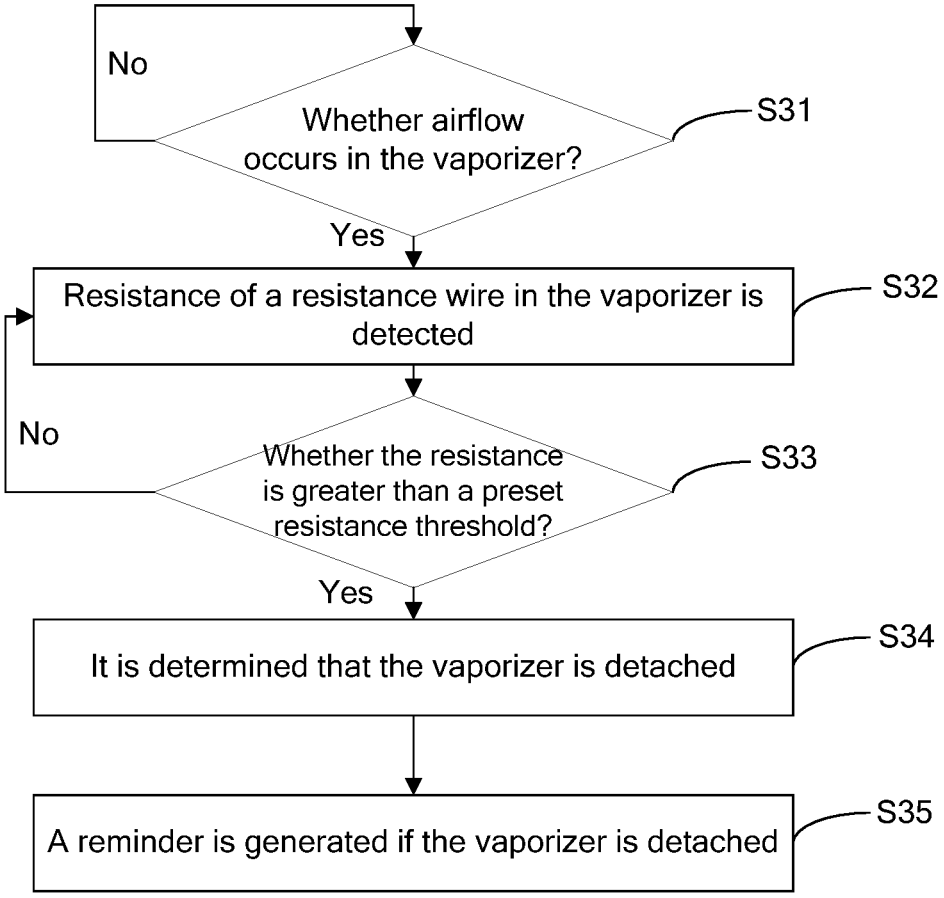
FIG. 3 is a flowchart of a reminding method in an electronic vaporizing-device according to yet other embodiments of the present disclosure.

FIG. 3 is a flowchart of a reminding method in an electronic vaporizing-device according to yet another some embodiments of the present disclosure. In this embodiment, the electronic vaporizing-device includes a vaporizer and a battery detachably connected. The method of this embodiment may include the following operations.

S31: It is detected whether airflow occurs in the vaporizer.

Airflow may possibly exist in the airflow channel in the vaporizer. An airflow sensor may be utilized to detect whether the air pressure in the vaporizer is negative. When a negative pressure is detected, it can be determined that there is airflow in the vaporizer. When it is detected there exists airflow in the vaporizer, operations in block S32 may be performed. Otherwise, detection of whether there is airflow in the vaporizer may be performed continuously.

S32: A resistance of a resistance wire in the vaporizer is detected.

S33: It is determined whether the acquired resistance is greater than a preset resistance threshold.

Operations in blocks S32 and S33 are similar to those described in S21 and S22, and will not be repeated herein. If the resistance of the resistance wire in the vaporizer is greater than the preset resistance threshold, operations in block S34 may be performed. Otherwise, detection of the resistance of the resistance wire in the vaporizer may be performed continuously.

S34: It is determined that the vaporizer is detached when there exists airflow in the vaporizer and the acquired resistance is greater than the preset resistance threshold.

Specifically, because airflow can occur in both situations where the vaporizer is detached or the user is smoking, it is required to detect the resistance of the resistance wire in order to further determine whether the vaporizer is detached. If airflow is detected by the airflow sensor and the acquired resistance of the resistance wire in the vaporizer is greater than the preset resistance threshold, it can be determined the vaporizer is detached.

S35: A reminder is generated if the vaporizer is detached.

In some embodiments, if existence of airflow is detected in the vaporizer and the acquired resistance of the resistance wire in the vaporizer is greater than the preset resistance threshold, it can be determined the vaporizer is rapidly detached, and a first way may be adopted to generate the reminder. When the vaporizer is detached rapidly, the duration of airflow detected by the airflow sensor may be lower than 500 ms. A rapid detachment can refer to a scenario where the user intentionally separates the vaporizer and the battery. Since this is a human operation, the speed of this active detachment of the vaporizer may be higher than that of passive detachment. Thus, airflow can be detected by the airflow sensor, and the value of resistance of the resistance wire can be further utilized to determine the way how the vaporizer is detached.

The first way described in this embodiment may be similar to but not exactly the same with the reminding way described in the embodiment of FIG. 2. Compared with operations in block S24, the first way of the present embodiment may set a color or frequency different from that of S24 for the light sources so as to remind the user that the vaporizer is detached rapidly. As for the embodiments with a sound display device or a vibration device, the first way of the present embodiment may similarly set a sound type, display frequency, vibration intensity or vibration frequency different from that of S24 so as to remind the user that the vaporizer is detached rapidly.

Compared with prior art, the reminding method in an electronic vaporizing-device of the present embodiment may determine whether the vaporizer is detached by detecting airflow in the vaporizer and resistance of the resistance wire, and accordingly remind the user. Thus, user experience may be improved.

Figure 4:
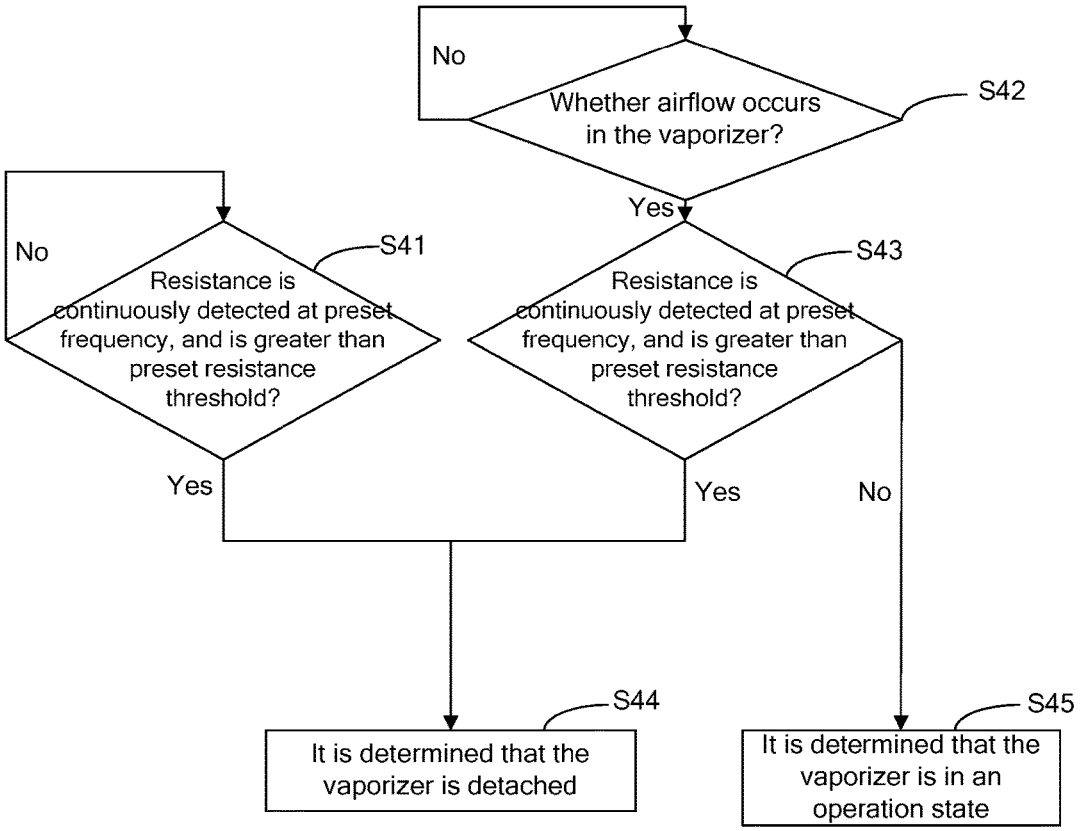
FIG. 4 is a flowchart of a reminding method in an electronic vaporizing-device according to still yet other embodiments of the present disclosure.

FIG. 4 is a flowchart of a reminding method in an electronic vaporizing-device according to another some embodiments of the present disclosure. In the present embodiment, the electronic vaporizing-device includes a vaporizer and a battery detachably connected to the vaporizer. The method includes the following operations.

S41: Resistance of the resistance wire in the vaporizer is detected at a preset frequency, and it is determined whether the acquired resistance is greater than a preset resistance threshold.

The voltage between two ends of the resistance wire in the vaporizer and the current passing through the vaporizer may be detected at a preset frequency, and then the resistance of the resistance wire can be calculated based on the equation $$R = \frac{U}{I}.$$

At the same frequency, it can be determined whether the acquired resistance is greater than a preset resistance threshold. In some embodiments, the preset frequency may be every 200 ms, and the present resistance threshold may be 0.6 to 1.5 Ohms, the exact value of which can be determined based on the user's requirement.

If the calculated resistance is greater than the preset resistance threshold, it can be determined that the vaporizer is slowly detached and operations in block S44 may be performed. Otherwise, the detection of resistance of the resistance wire in the vaporizer at the preset frequency may be performed continuously.

S42: It is detected whether airflow occurs in the vaporizer.

An airflow sensor may be utilized to detect whether the air pressure in the vaporizer is negative. If a negative pressure is detected, it can be determined that there exists airflow in the vaporizer, and operations in block S43 may be performed.

Similarly, existence of airflow in the vaporizer may be repeatedly detected at a certain frequency.

S43: Resistance of the resistance wire in the vaporizer is continuously detected at the preset frequency, and at the same time it is determined whether the acquired resistance is greater than the preset resistance threshold.

A method similar to S41 may be utilized to detect and compare the resistance of the resistance wire in the vaporizer. If the calculated resistance is greater than the preset resistance threshold, it can be determined that the vaporizer is detached rapidly and operations in block S44 may be performed. Otherwise, operations in block S45 may be performed.

S44: It is determined the vaporizer is detached and a reminder is generated.

According to the present embodiment, when the vaporizer is detached slowly, it is possible that the airflow sensor cannot detect negative pressure. Thus, the implementation of the operations described in blocks S42-S43 cannot identify this kind of detachment of the vaporizer. If only the operations described in S41 is adopted, the reminder is generated after a certain delay time when the vaporizer is detached rapidly because of its low response speed, which brings poor user experience.

Thus, in the present embodiment, the above methods are integrated to monitor the vaporizer. In this way, no matter in which way the vaporizer is detached, the user can be reminded.

In some embodiments, a first way may be adopted to remind the user, which may be similar to that described in foregoing embodiments.

S45: It is determined that the vaporizer is in an operation state.

When it is detected there is airflow in the vaporizer and the resistance of the resistance wire in the vaporizer is smaller than the preset resistance threshold, it can be derived that the entire device is in an operation state and the airflow is caused by smoking of the user.

Compared with prior art, the reminding method of an electronic vaporizing-device of the present embodiment may identify how the vaporizer is detached by detecting airflow in the vaporizer and resistance of the resistance wire in the vaporizer, and then remind the user. Thus, the user experience may be improved.

Figure 5:
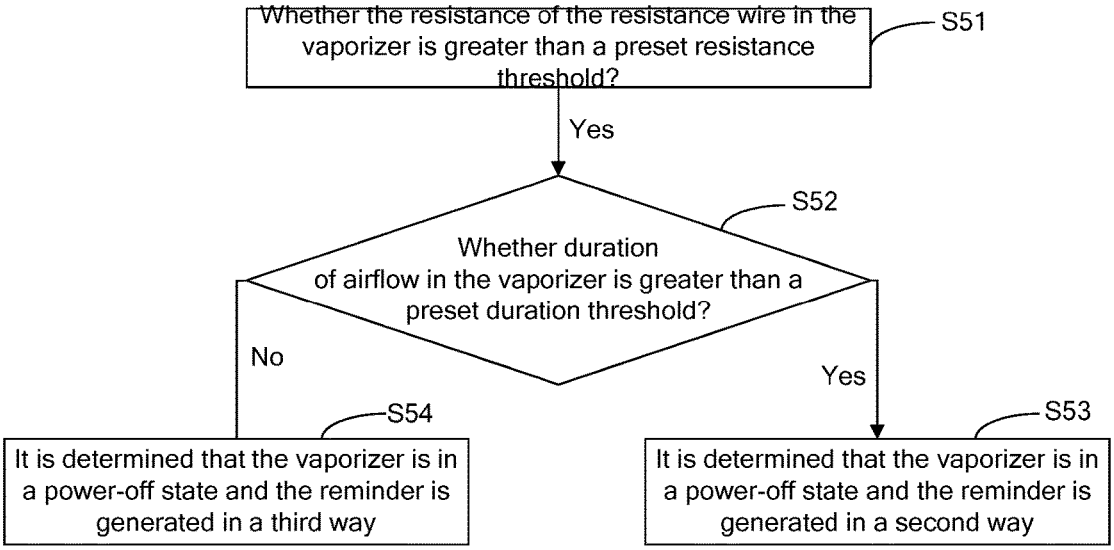
FIG. 5 is a flowchart of a reminding method in an electronic vaporizing-device according to other embodiments of the present disclosure.

FIG. 5 is a reminding method in an electronic vaporizing-device according to yet other embodiments of the present disclosure. The method includes the following operations.

S51: It is detected whether the resistance of a resistance wire in the vaporizer is greater than a preset resistance threshold.

The resistance of the resistance wire in the vaporizer is normally smaller than the preset resistance threshold when the electronic vaporizing-device is in an operation state. Thus, by detecting the resistance of the resistance wire in the vaporizer, the working state of the vaporizer may be detected and identified.

The method of detection may be similar to that described in S21 to S22, which will not be repeated herein.

S52: If the acquired resistance is greater than the preset resistance threshold, it is detected whether a duration of airflow in the vaporizer is greater than a preset duration threshold.

If it is detected that the resistance of the resistance wire in the vaporizer is greater than the preset threshold, the electronic vaporizing-device may run in a no-load state. This may be due to the detachment of bad connection of the vaporizer. Thus, airflow, specifically the duration of airflow, in the vaporizer is further detected. It is determined whether the duration is greater than a preset duration threshold. When the vaporizer is rapidly detached, the duration of airflow is normally less than 500 ms. When the vaporizer is slowly detached, no airflow can be detected. If the duration of airflow is greater than 500 ms, it may indicate that the user is smoking. Thus, the preset duration threshold can be set as 500 ms.

In some embodiments, when the resistance of the resistance wire in the vaporizer detected is less than the preset resistance threshold, it can be determined the vaporizer is in an operation state. Thus, operations described in previous embodiment, i.e., operations in blocks S11-S13 can be performed.

If the duration of airflow is greater than the preset duration threshold, operations in block S53 may be performed. Otherwise, operations in block S54 may be performed.

S53: If the duration of airflow is greater than the preset duration threshold, it is determined the vaporizer is in a power-off state, and the reminder is generated in a second way.

When a user plugs the vaporizer into the battery, the user does not know exactly whether the connection is successful and may try to smoke. A normal smoking duration is greater than 500 ms. Thus, if the duration of airflow detected by the airflow sensor is greater than the preset duration threshold, i.e., 500 ms, it can be determined the vaporizer is not detached but is in a power-off state either. In this situation, a second way may be adopted to remind the user that the vaporizer is in a power-off state correctly.

In some embodiments, the second way may include setting the LED light to generate red light and flash at a certain frequency, for example, the LED light may be controlled to emit red light and be kept on. In other embodiments, a sound display device may be utilized to remind the user by generating sounds with a certain intensity and tone. In other embodiments, a vibration device may be utilized to remind the user by generating vibration with a certain vibration frequency. All the above can be utilized to remind the user that the vaporizer is in a power-off state correctly.

S54: If the duration of airflow is less than the duration threshold, it is determined the vaporizer is in a power-off state, and a third way may be adopted to remind the user.

In some embodiments, the detected duration of airflow in the vaporizer is less than the preset duration threshold while the resistance of the resistance wire in the vaporizer is greater than the present resistance threshold, which indicates that the airflow sensor detects the airflow but the duration of the airflow is small. In this situation, it can be determined that the vaporizer is detached. Accordingly, a third way may be adopted to remind the user that the vaporizer is detached. The third way may be similar to or different from the first way.

Compared with prior art, the reminding method in an electronic vaporizing-device provided in the present embodiment may identify the working state of the vaporizer by detecting airflow and resistance of the resistance wire in the vaporizer, and may generate a reminder to the user. Thus, user experience may be improved.

Figure 6:
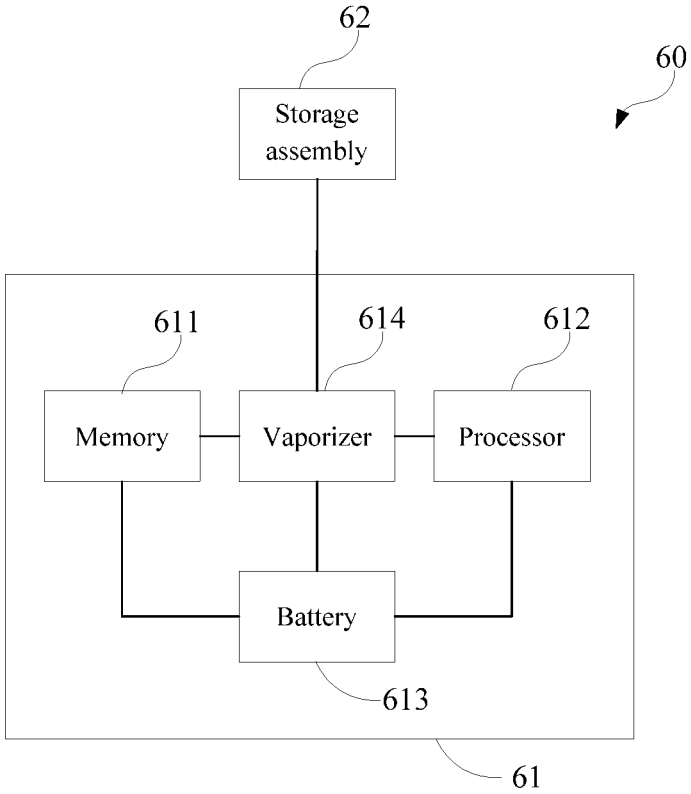
FIG. 6 is a schematic diagram of an electronic vaporizing-device according to some embodiments of the present disclosure.

FIG. 6 is a schematic diagram of an electronic vaporizing-device according to some embodiments of the present disclosure. The electronic vaporizing-device 60 includes a body 61 and a storage assembly 62. The body 61 includes a memory 611, a processor 612, a battery 613, and a vaporizer 614. The memory 611 may be coupled to the processor 612 through, for example, the data bus. The vaporizer 614 and the body 61 may be detachably connected, and the vaporizer 614 and the battery 613 may also be detachably connected.

The storage assembly 61 may store a feature parameter. One feature parameter may correspond to one type of vaporizer 614. The body 51 may be configured to acquire the feature parameter from the storage assembly 62, and to heat the vaporizer 614 according to the feature parameter. The vaporizer 614 may be utilized to heat the smoke generating material (e.g., tobacco liquid) to generate smoke.

The memory 611 may be utilized to store program instructions, which, when executed by the processor 612, implement the following reminding method for the electronic vaporizing-device.

Detecting an electrical parameter of the vaporizer; determining whether the vaporizer is detached based on the electrical parameter of the vaporizer; and based on determination that the vaporizer is detached, generating a reminder.

It should be noticed, the electronic vaporizing-device 60 provided in the present embodiments is a terminal realized based on the methods described in above embodiments. Similar principles and operations will not be repeated herein. When the program instructions are executed by the processor 612, the method described in anyone of the above-described embodiments can be achieved.

Figure 7:
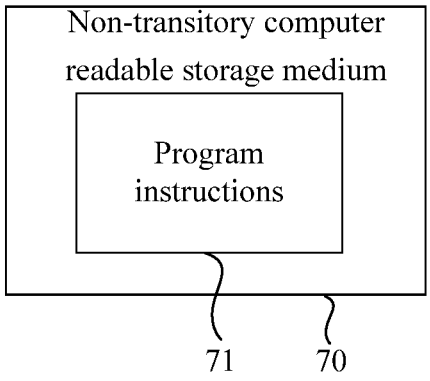
FIG. 7 is a schematic diagram of a non-transitory computer readable storage medium according to some embodiments of the present disclosure.

FIG. 7 is a schematic diagram of a non-transitory computer readable storage medium according to some embodiments of the present disclosure.

The non-transitory computer readable storage medium 70 is configured to store program instructions 71 which, when executed by a processor, implement the following method.

Detecting an electrical parameter of the vaporizer; determining whether the vaporizer is detached based on the electrical parameter of the vaporizer; and based on determination that the vaporizer is detached, generating a reminder.

It should be noticed, the method based on the program instructions 71 in the present embodiments is based on the methods described in above embodiments. Similar principles and operations will not be repeated herein. When the program instructions 71 are executed by the processor, the method described in anyone of the above-described embodiments can be achieved.

Embodiments of the present disclosure, when implemented in form of software functional units and sold or used as dependent product, may be stored in a computer readable storage medium. Based on such understanding, the technical solution of the present disclosure, in essence, a part making a contribution over the prior art, or all/part of the technical solution may be embodied in the form of a software product stored in a storage medium. A number of instructions are included to cause a computer device (which may be a personal computer, server, or network device, etc.) or a processor to perform all or part of the actions/operations of the methods described in various embodiments of the present disclosure. The foregoing storage medium may include: a U disk, a mobile hard disk, a read-only memory (ROM), a random access memory (RAM), a magnetic disk, or an optical disk, and the like.

The foregoing is merely embodiments of the present disclosure, and is not intended to limit the scope of the disclosure. Any transformation of equivalent structure or equivalent process which uses the specification and the accompanying drawings of the present disclosure, or directly or indirectly application in other related technical fields, are likewise included within the scope of the protection of the present disclosure.

What is claimed is:

1. A reminding method in an electronic vaporizing-device, the electronic vaporizing-device comprising a battery and a vaporizer detachably connected to the battery, the method comprising:

detecting an electrical parameter of the vaporizer;

determining whether the vaporizer is detached from the battery based on the electrical parameter of the vaporizer; and generating a reminder in response to the vaporizer being detached from the battery, wherein before the detecting an electrical parameter of the vaporizer, the method further comprises:

detecting whether airflow occurs in the vaporizer;

wherein the detecting the electrical parameter of the vaporizer is performed in response to the airflow occurring in the vaporizer.

2. The method of claim 1, wherein the detecting the electrical parameter of the vaporizer comprises:

detecting a resistance of a heating component in the vaporizer;

the determining whether the vaporizer is detached based on the electrical parameter of the vaporizer comprises:

determining whether the resistance is greater than a preset resistance threshold, and determining that the vaporizer is detached from the battery in response to the resistance being greater than the preset resistance threshold.

3. The method of claim 2, wherein the detecting whether airflow occurs in the vaporizer is performed before the detecting the resistance of the heating component in the vaporizer, and wherein the detecting the resistance of the heating component in the vaporizer is performed in response to airflow occuring in the vaporizer.

4. The method of claim 3, further comprising:

continuously detecting the resistance of the heating component in the vaporizer at a preset frequency; and reperforming the determining whether the resistance is greater than the preset resistance threshold.

5. The method of claim 2, wherein the detecting the resistance of the heating component in the vaporizer comprises:

continuously detecting the resistance of the heating component in the vaporizer at a preset frequency.

6. The method of claim 2, wherein the generating the reminder comprises:

generating the reminder in a first way in response to the resistance being greater than the preset resistance threshold.

7. The method of claim 1, further comprising:

determining whether a resistance of a heating component in the vaporizer is greater than a preset resistance threshold;

in response to the resistance being greater than the preset resistance threshold, determining whether a duration of airflow in the vaporizer is greater than a preset duration threshold; and determining that the vaporizer is in a power-off state and generating the reminder in a second way, in response to the duration of airflow in the vaporizer being greater than the preset duration threshold.

8. The method of claim 7, further comprising:

in response to the resistance is less than the preset resistance threshold, determining that the vaporizer is in an operation state, and reperforming the detecting the electrical parameter of the vaporizer; or in response to the duration of airflow in the vaporizer is less than the preset duration threshold, determining that the vaporizer is detached from the battery and generating the reminder in a third way.

* * * * *